US006059032A

United States Patent [19]

Jones

[11] Patent Number: 6,059,032

[45] Date of Patent: May 9, 2000

[54] METHOD AND APPARATUS FOR TREATING LONG FORMATION INTERVALS

[75] Inventor: Lloyd G. Jones, Dallas, Tex.

[73] Assignee: Mobil Oil Corporation, Fairfax, Va.

[21] Appl. No.: 08/987,936

[22] Filed: Dec. 10, 1997

[51] Int. Cl.[7] ..... E21B 21/10; E21B 37/00; E21B 43/04

[52] U.S. Cl. ..... 166/278; 166/51; 166/157; 166/193; 166/222; 166/284; 166/305.1; 166/312; 166/325

[58] Field of Search ..... 166/222, 242, 166/278, 284, 305.1, 325, 51, 312, 193, 320, 75.15, 157, 205

[56] References Cited

U.S. PATENT DOCUMENTS

| | | | |
|---|---|---|---|
| 2,933,136 | 4/1957 | Ayers et al. | 166/284 |
| 4,387,770 | 6/1983 | Hill | 166/305 |
| 4,450,914 | 5/1984 | Elphick | 166/325 |
| 4,945,991 | 8/1990 | Jones . | |
| 5,113,935 | 5/1992 | Jones et al. . | |
| 5,161,613 | 11/1992 | Jones . | |
| 5,161,618 | 11/1992 | Jones . | |
| 5,253,709 | 10/1993 | Kendrick et al. | 166/284 |
| 5,419,394 | 5/1995 | Jones | 166/51 |

*Primary Examiner*—David Bagnell
*Assistant Examiner*—Chong S. Cho
*Attorney, Agent, or Firm*—Malcolm D. Keen

[57] ABSTRACT

A method and apparatus for treating a long interval within a wellbore wherein a treatment fluid is delivered to selected levels within the interval by blocking flow to certain zones while allowing flow to others. A treatment tube extends substantially through the interval and is comprised of a perforated conduit which is open at its upper end and which has a plurality of openings spaced along its length. Each of the openings have a valve seat within the conduit at its entrance which is adapted to receive a valve to seal and block flow through that opening. In operation, a treatment fluid is flowed through the treatment tube and out the openings into different levels within wellbore. At desired intervals, the valve are introduced into the treatment fluid and are carried into the treatment tube to seat at a respective opening to thereby block flow through that opening while allowing continued flow through others.

14 Claims, 2 Drawing Sheets

METHOD AND APPARATUS FOR TREATING LONG FORMATION INTERVALS

DESCRIPTION

1. Technical Field

The present invention relates to treating a subterranean formation and in one aspect relates to a method and apparatus for treating (e.g.. consolidating, acidizing, etc.) a long treatment interval of a formation in a single operation wherein the treatment fluid can be delivered directly to the different levels in the interval while blocking flow of the treatment fluid to other levels within the interval.

2. Background

In producing hydrocarbons or the like from a well, it is not uncommon to treat a subterranean formation(s) to improve production and/or to extend the operational life of a well. For example, in "open-hole" completions, it is common to "wash" the wellbore adjacent the formation with a treating fluid (e.g.. an acid) to remove the filter cake left by the drilling fluid on the wall of the wellbore before commencing production. Also, it is common to "acidize" long production intervals where the producing interval lies within a limestone or like reservoir by injecting an acid into the formation to dissolve a portion of the carbonate material thereby increasing the permeability and hence, the production from the reservoir.

Other formations are often treated to prevent or alleviate the production of sand along with the production fluids. As is known in the art, certain loosely-consolidated and/or fractured formations normally produce relatively large volumes of sand along with the formation fluids which, if not controlled, can seriously affect the economics of the well. One known technique for controlling sand production involves "consolidating" the formation by injecting a consolidating agent (e.g.. thermosetting resin) down the wellbore and into the formation. As the resin penetrates into the formation, it coats the sand grains around the wellbore. The temperature in the formation then causes the resin to harden thereby cementing the grains together into a solidified, permeable mass which, in turn, allows fluid flow therethrough while effectively blocking the flow of particulate material into the wellbore.

Another well known sand control technique involves "gravel-packing" the wellbore wherein a screen is positioned in the wellbore adjacent the producing formation and the annulus around the screen is filled with gravel. The gravel effectively blocks the flow of sand therethrough while allowing the formation fluids to flow through the gravel and into the screen to be produced to the surface. Again, it is often desirable to "wash" the wellbore with an acid or the like before or after the gravel is placed in order to improve or stimulate production.

In well treatments such as those described above, problems often arise when used in treating long or thick intervals within a wellbore (i.e. an interval which extends along a substantial portion of the wellbore) This is due to the fact that one can not be sure that the treating fluid will come into contact with all levels of the formation throughout the long interval. As will be recognized by those skilled in the art, if certain levels or areas of the interval remain untreated, the overall effectiveness of the treatment operation may be greatly diminished.

In certain known prior art treating methods, it is necessary to individually treat different zones within a long interval. This is done by setting packers in the wellbore to isolate a first zone within the interval and then delivering a treatment fluid to just that zone. After the first zone is treated, the packers are moved and a different zone is isolated and this procedure is repeated until all of the desired zones within the interval have been treated. Of course, this setting and resetting of the packers and the treatment of several zones is both time consuming and expensive to carry out.

Recently, alternate flow path tools have been developed which are capable of simultaneously delivering fluid to the different levels throughout a long treatment interval; e.g. U.S. Pat. Nos. 4,945,991; 5,113,935; 5,161,613; 5,161,618. Alternate flow path tools are those which include at least one shunt tube or conduit which, in turn, extends through the interval of interest. The conduit has a plurality of openings spaced along its length whereby fluid which enters either the top or the bottom of the conduit can exit through the openings at different level within the interval. This allows the fluid to reach the different levels within the interval even if a sand bridge or other flow obstruction is formed within the well annulus before the treatment operation is complete.

SUMMARY OF THE INVENTION

The present invention provides a method and apparatus for treating a long interval within a wellbore wherein a treatment fluid is delivered to selected levels within the interval by blocking flow to certain zones while allowing flow to others. More specifically, the present invention provides an apparatus which is comprised of a workstring which, in turn is comprised of a conduit having a perforated section at its lower end. The perforated section is adapted to be positioned adjacent to and extend substantially through said long interval to be treated;

The perforated section has a plurality of openings spaced along its length for delivering the treatment fluid from the workstring to the different levels within the long interval. Each of the openings has a valve seat within the perforated section which is adapted to receive a valve means, (e.g. a ball valve) for closing flow through that opening when the valve means is on the valve seat. Some of the openings in the perforated section can be larger than others in the section whereby larger volumes of treatment fluid can be delivered to selected levels within the interval. The perforated section may have the same diameter as said conduit (i.e. an extension of the workstring) or the diameter of said perforated section may be smaller that the diameter of said conduit (i.e. a treatment tube extending from the bottom of the conduit).

The valve seats for the openings may be formed in a variety of ways. For example, each valve seat may be formed by securing one end of a cylindrical extension over the exit of a respective opening and providing a small opening or port through the other end thereof. Each cylindrical extension is adapted to receive a respective valve means which seats on and blocks flow through the small port. Some of seats can be formed by angling the longitudinal axis of said cylindrical extension downwardly with respect to the longitudinal axis of the conduit. Still further, the valve seat may be formed by positioned a ring inside the conduit and around the exit of said opening wherein the ring is adapted to receive a valve means. A valve catcher may be provided on the lower end of the perforated section of the conduit to collect the valve means after the treatment operation is completed.

In a further embodiment, the present invention is incorporated into gravel-packing completions. First, a well screen is lowered on a workstring and is positioned adjacent to and extends substantially through the long interval to be completed. A treatment tube is positioned in well annulus along side the screen and extends substantially all the way through the interval. As before, the treatment tube is comprised of a perforated conduit which is open at its upper end and which has a plurality of openings spaced along its length. Each of the openings have a valve seat within said conduit at its entrance which is adapted to receive a valve means to seal and block flow through that opening.

In operation, a treatment fluid is flowed down the wellbore, through the treatment tube, and out through the openings in the treatment tube into different levels within said wellbore. At desired intervals, valve means (preferably having a density approximately equal to the density of the treatment fluid) are introduced at the surface into the stream of the treatment fluid whereby the valve means are carried down the well by the treatment fluid. Each of the valve means will enter the treatment tube and seat at a respective opening to thereby block flow therethrough. This allows flow of treatment fluid to be blocked through selective openings while allowing continued flow through others. By sizing the openings and/or selectively releasing the valve means, more or less treatment fluid can be delivered to selected levels or zones within the long interval, depending on the particular interval being treated.

BRIEF DESCRIPTION OF THE DRAWINGS

The actual construction operation, and apparent advantages of the present invention will be better understood by referring to the drawings, not necessarily to scale, in which like numerals identify like parts and in which.

BEST KNOWN MODE FOR CARRYING OUT THE INVENTION

Figure 1:
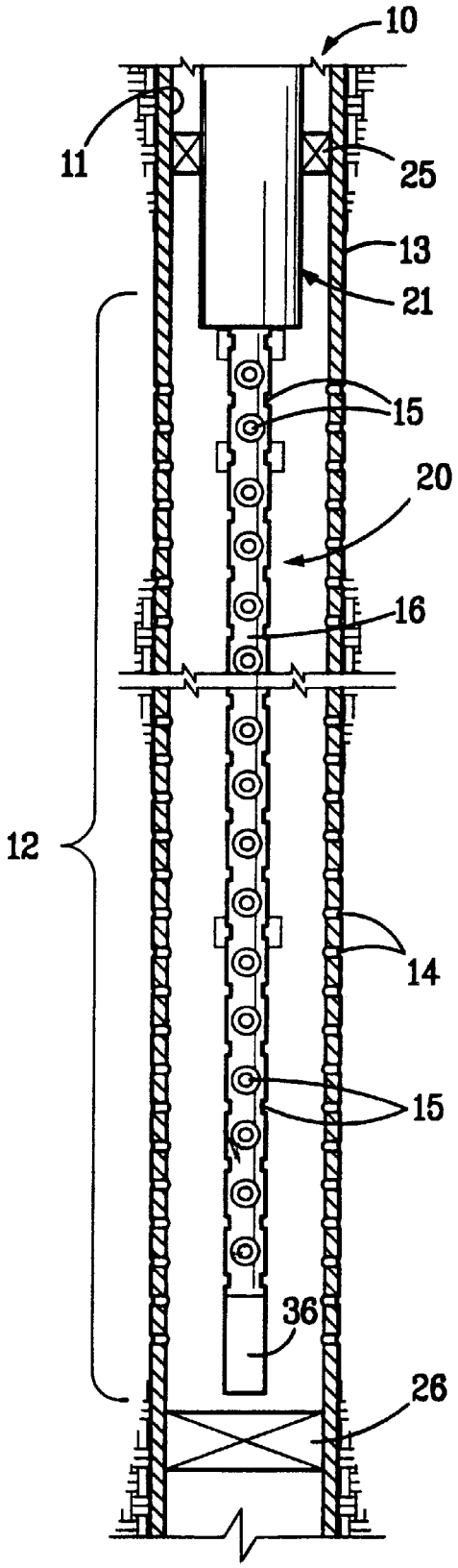
FIG. 1 is an elevational view, partly in section, of a well treating apparatus in accordance with the present invention having a treatment tube for delivering a treatment to different levels within a wellbore while blocking flow to other levels within the interval.

Referring more particularly to the drawings, FIG. 1 illustrates the lower end of a producing/injection well 10. Well 10 has a wellbore 11 which extends from the surface (not shown) through a long or thick treatment interval 12. Wellbore 11 is typically cased with a casing 13 which, in turn, is cemented (not shown in FIG. 1) in place and has spaced perforations 14 adjacent interval 12 as will be understood in the art. While the present invention is illustrated in relation to a vertical cased wellbore, it should be recognized that the present invention can also be used in open-hole and/or underreamed completions as well as in inclined and horizontal wellbores, as the situation dictates.

Well treating apparatus 20 of the present invention is positioned in wellbore 11 and is comprised of a workstring 21 which is adapted to extend downward from the surface into the wellbore and through the treatment interval 12. Workstring 21 is comprised of conduit having a perforated section which, in turn, has a plurality of spaced openings 15 spaced along its length which lies adjacent the interval 12 to be treated. Workstring 21 may have a uniform diameter throughout its length (i.e. merely be an extension of the workstring) or, as illustrated in FIG. 1, it may include a reduced-diameter, treatment tube or conduit 16 at its lower end which extends substantially throughout interval 12. Packers 25, 26 or the like are set to isolate the section of wellbore 11 which lies adjacent interval 12, as will be understood in the art.

In operation, a treating fluid, e.g. consolidating agent—resin, sodium silicate, or the like —or an acid —hydrochloric, etc.— is flowed down the workstring 21 under pressure and will exit out through openings 15 into the isolated section of wellbore 11 along interval 12. Openings 15 may be of any practical size or shape but preferably, are small circular holes (e.g. from ⅛ to about ¾ inches in diameter) whereby each of the openings forms a nozzle which, in turn, directs a powerful jet of the treatment fluid against wall of an open hole or against perforations 14 if the wellbore is cased at different levels within interval 12. The limited amount of treatment fluid which can flow through any single opening or nozzle provides a good distribution of the treatment fluid along a considerably long treatment interval. Both the construction and the operation of well tool 20 to this point is basically the same as that disclosed in U.S. Pat. No. 5,161,613, which is incorporated herein by reference. As will be understood in the art, the treatment tube 16 of well tool 20 will deliver treatment fluid to all levels within the long interval 16 even if a sand bridge or other obstruction (not shown) develops within the well annulus around the tool before the treatment operation is completed thereby insuring that all areas of the interval will be contacted by treatment fluid during the treating operation.

Figure 2:
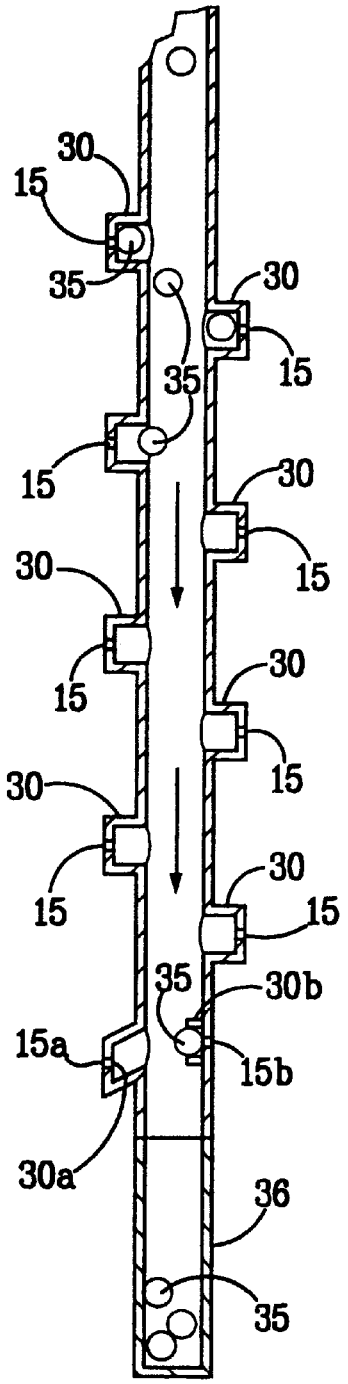
FIG. 2 is a sectional view of the lower portion of the treatment tube of FIG. 1 illustrating the ball valves seats at each of the openings in the tube, some of the seats having ball valves seated therein to block flow therethrough.

In accordance with the present invention, the entrances of substantially all of the openings 15 within workstring 21 or treatment tube 16 of the type described above are provided with a respective, internal valve seat 30. As best seen in FIG. 2, seats 30 may be provided in a variety of ways. For example, each opening 15 may be formed as a port through the end of a cylindrical projection or extension which, in turn, is sealably secured by welding or the like over a respective opening through the wall of conduit 16. The extension is sized to receive a valve means, e.g. ball valve 35, so that when a ball valve enters the extension and seats on the entrance of a respective port 15, further flow of fluid is blocked therethrough, as will be more fully discussed below. In some instances, it may be preferred to angle the longitudinal axis of the extension downward with respect to the longitudinal axis of treatment tube 16 (see opening 30*a* in FIG. 2) to thereby assist the ball valve onto its respective seat. Alternately, seats 30 can be formed by providing a ring seat 30*b* (only one shown) internally around an opening or port 15*b* whereby a cooperating ball valve seats on the ring to block flow through the opening 15*b*.

As in the prior art, a treatment fluid (e.g. an acid) is flowed down workstring 21 and out the openings 15 into the interval to be treated. However, in accordance with the present invention, at any desired time during the treatment operation, one or more individual ball valves 35 may be periodically introduced at the surface into the stream of treatment fluid as it flows into well 10. The ball(s) 35 flow downwardly through the workstring 21 and will be carried into a respective valve seat(s) by the treatment fluid as it exits (i.e. jets) through a respective opening 15. The ball valve, once seated, blocks further flow of treatment fluid through that opening. Once an opening 15 is blocked by a ball valve 35, all of the treatment fluid must now flow through the remaining unlocked openings 15 in conduit 16, thereby insuring good distribution of fluid across interval 12 and concentrating treatment fluid where needed most. Further, by properly sizing the diameters of the valve seats, different sized ball valves can be used to close a respectively-sized opening whereby, larger amounts of treating fluid can be delivered to selective levels with interval 12 or the fluid can be delivered for longer periods of time to certain levels than to others.

That is, the diameters of certain openings 15 at selected intervals at any point along conduit 16 may be substantially larger than the diameters of other openings 16 thereby allowing a larger volume of the treating fluid to flow through these larger openings to thereby deliver larger quantities of treating fluid which may be needed to adequately treat a localized or selected zone within treatment interval 12. Then, by introducing the proper-sized ball valves 30 into the treatment fluid stream at the appropriate time, the larger openings can be blocked and the treatment fluid can then be diverted to other zones within the treatment interval, if so desired. Where all of openings 15 have substantially the same diameter and the same size ball valves 30 are used, normally the openings 15 will be blocked one-by-one beginning with the openings at the top of treatment tube and then moving downward since the first ball will be carried onto the uppermost valve seat as the ball valves entered the treatment tube.

Ball valves 30 may be made of any material which will be durable in the treatment fluid and which will block flow once seated at an opening 15. Preferably, ball valves 30 are made of a material whose density is substantially the same as that of the treatment in which it is to be introduced. This allows the ball valves to be suspended within the fluid rather than sinking through or floating within the treatment fluid. For example, in an acid such as hydrocarbon, an acid-resistive plastic or rubber-like material, hollow if necessary, may be used.

A ball valve catcher 36 may be provided at the lower end of conduit 16 to "catch" the ball valves 35 after a particular treatment operation has been completed. Once the pressure on the treatment fluid has been relaxed, fluid from the well bore can flow back into conduit 16 thereby forcing the balls off their respective seats whereby the balls fall within the conduit to be caught by catcher 36. This allows all of the ball valves to then be retrieved from the wellbore along when tool 20 is withdrawn.

Figure 3:
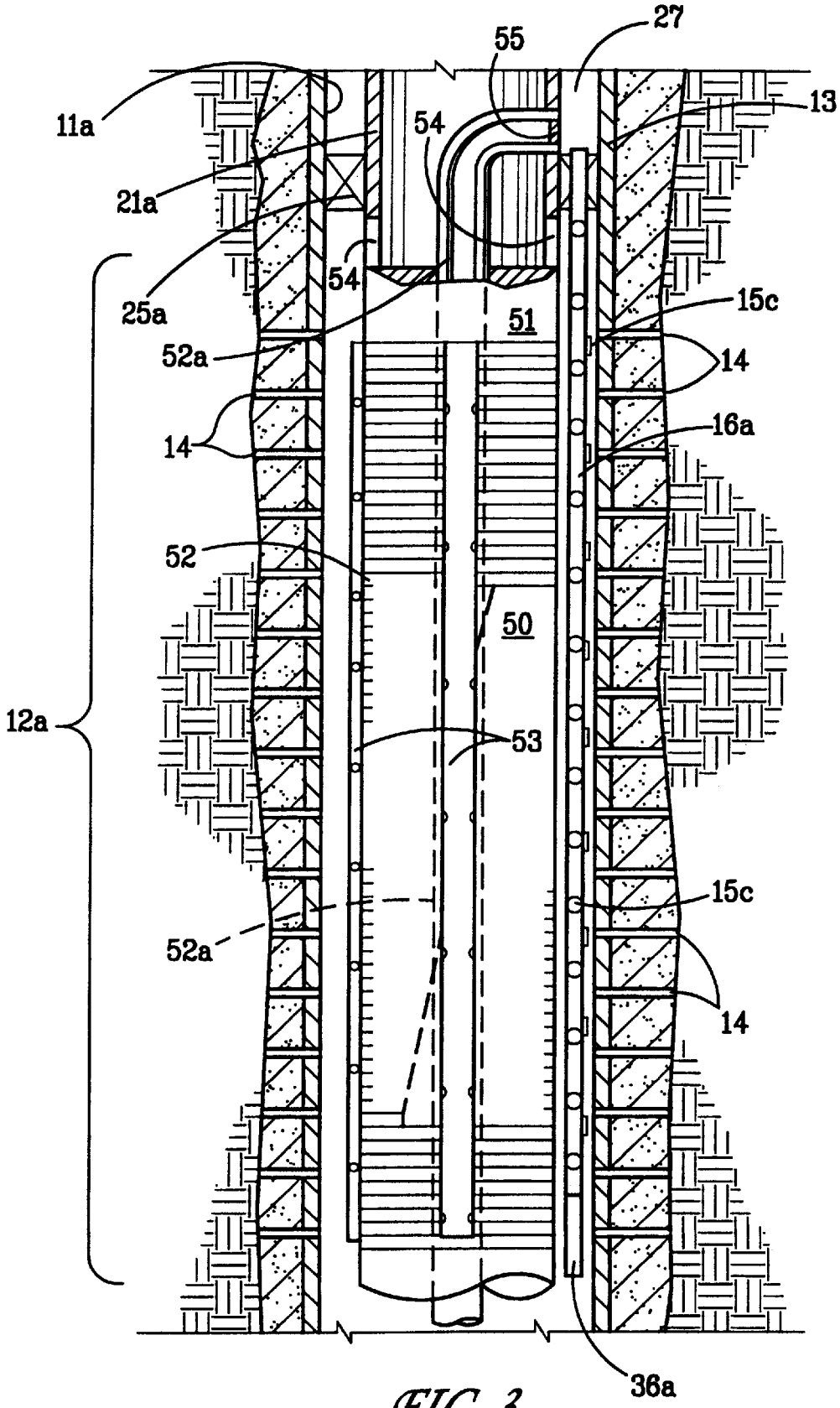
FIG. 3 is a elevational view, partly in section, of a further embodiment of the present invention wherein the well treatment method is carried out in conjunction with a gravel-pack completion.

FIG. 3 illustrates a further embodiment of the present invention when used in a gravel-pack completion. A well screen 50 having a "cross-over" 51 at its upper end is attached to the lower end of workstring 21*a* and is lowered within wellbore 11*a* to a point adjacent the treatment interval 12*a* which, in turn, is isolated by packer 25*a* or the like. Well screen 50 may be of any type commonly used in gravel-pack completions but preferably is an alternate flowpath well screen of the type disclosed in U.S. Pat. Nos. 4,945,991 and 5,113,935, both of which are incorporated herein by reference.

As will be understood in the art, screen 50 is comprised of a screen section 52 having a wash pipe 52*a* extending therethrough and one or more perforated shunts tubes 53 extending along its length. Once the screen is positioned within the wellbore, gravel (not shown) is pumped down workstring 21*a*, out through ports 54 in cross-over 51, and into the isolated well annulus surrounding screen section 52. Gravel also enters shunt tubes 53 and exits through the perforations therein to deliver gravel to all levels of the annulus thereby insuring good distribution of gravel across the treatment interval even if a flow obstruction occurs in the annulus before all of the gravel has been deposited.

In accordance with the present invention, one or more treatment tubes 16*a* (only one shown) extend substantially parallel to screen 50 and extend substantially throughout treatment interval 12*a*. Each treatment tube 16*a* has a plurality of openings 15*c* spaced along its length (only a few of the openings 15*c* are numbered for the sake of clarity). Each treatment tube 16*a* passes through the packer and is open at its upper end to receive treatment fluid.

Prior to the placement of the gravel, treatment fluid, e.g. an acid, can be pumped down the well annulus 27 and into the open upper end of treatment tube(s) 16*a*. Openings 15*c* direct a jet of fluid out against the wellbore to remove filter cake, etc. from the wellbore in open-hole completions and/or gels, resins, etc. from perforations in cased completions. As fully described and discussed above, ball valves 35 (not shown in FIG. 3) can be periodically introduced into the treatment fluid stream to cooperate with a respective, internal valve seats within treatment tube 16*a* to block flow through that respective opening 15*c* while flow continues through the other openings. This allows larger qualities of treatment fluid to be delivered to a selected area or for longer times if needed in the particular treatment operation. A shear disk 55 or the like may be used to originally close wash pipe 53 above packer 25*a* during the treatment operation to prevent substantial amounts of the treatment fluid from by-passing the treatment tube through the washpipe 52*a*. As will be understood, disk 55 will rupture when the pressure in annulus 27 reaches a predetermined pressure , i.e. a pressure above that used in the treatment operation.

Ball catcher 36*a* may be provided on the lower end of treatment tube(s) 16*a* to "catch" the ball valves after the treatment operation has been completed. That is, during the subsequent gravel-pack operation, any ball valves will be forced off their respective seats and will fall to the bottom of the treatment tube and into catcher 36*a*. This re-opens all of the openings 15*c* so that the treatment tube(s) can now be used to treat the gravel pack around the screen to remove the carrier fluid used in the placement of the gravel. To do this, an appropriate treatment fluid is again pumped down annulus 27 and through tube(s) 16*a* to be delivered to all levels within the gravel-pack.

What is claimed is:

1. An apparatus for treating a long interval within a wellbore, said apparatus comprising:

a workstring comprising a conduit having a perforated section adapted to be positioned adjacent to and extend substantially through said long interval to be treated;

said perforated section having a plurality of openings spaced along its length for delivering a treatment fluid from within said section of said conduit to different levels within said long intervals, each of said openings having a valve seat internally of said perforated section adapted to receive a valve means for closing flow through said opening when said valve means is on said valve seat.

2. The apparatus of claim 1 wherein some of said openings are larger than the other of said openings.

3. The apparatus of claim 1 wherein said perforated section has the same diameter as said conduit.

4. The apparatus of claim 1 wherein the diameter of said perforated section is smaller that the diameter of said conduit.

5. The apparatus of claim 1 wherein said valve seat comprises:

a cylindrical extension having one end secured over the exit of said opening and having a small port through the other end thereof; said cylindrical extension being adapted to receive said valve means therein whereby said valve means will seal on and block flow through said small port.

6. The apparatus of claim 5 where the longitudinal axis of said cylindrical extension is at a downward angle with respect to the longitudinal axis of said conduit.

7. The apparatus of claim 1 wherein said valve means comprises a ball valve.

8. The apparatus of claim 1 wherein said valve seat comprises:

a ring positioned internally of said conduit and around the exit of said opening and being adapted to receive said valve means for sealing and blocking flow through said opening.

9. The apparatus of claim 1 including:

a catcher on the lower end of said perforated section of said conduit for collecting said valve means within said conduit.

10. A well treating apparatus for treating and gravel packing a long interval of a wellbore, said apparatus comprising:

a well screen on the lower end of a workstring, said screen being positioned adjacent to and extending substantially through said long interval and forming an annulus between said wellbore and said screen; and a treatment tube in said annulus and extending substantially parallel to said screen and substantially through said interval, said treatment tube comprising:

perforated conduit open at its upper end and having a plurality of openings spaced along its length, each of said openings having a valve seat within said conduit at the entrance to said opening, said valve seat adapted to receive a valve means to seal and block flow through said opening.

11. A method for treating a long interval of a wellbore, said method comprising:

positioning a treatment tube having a plurality of spaced openings along its length adjacent to and extending substantially through said long interval, said treatment tube being carried on the lower end of a workstring which extends through said wellbore from the surface;

flowing a treatment fluid down said workstring, through said treatment tube and out through said openings into different levels within said wellbore; and introducing valve means to said treatment fluid before it flows down said workstring whereby said valve means will enter said treatment tube and seat at some of said openings to block flow through said some of said openings while allowing flow to continue through other of said openings.

12. The method of claim 11 wherein said valve means are comprised of ball valves.

13. The method of claim 12 wherein said ball valves are comprised of material having substantially the same density as that of the treatment fluid.

14. The method of claim 13 wherein said treatment tube extends substantially parallel to a well screen which extends substantially through said long interval.

* * * * *